United States Patent [19]

Williams et al.

[11] 3,951,206

[45] Apr. 20, 1976

[54] ROTARY DISC TYPE HEAT EXCHANGER

[75] Inventors: Norman E. Williams, St. Paul; David L. Phillips, Fridley; Richard A. Ley, Minneapolis; Bruce Beaubien, St. Paul; Richard L. Brown, Eagan, all of Minn.

[73] Assignee: The Strong-Scott Mfg. Co., Minneapolis, Minn.

[22] Filed: Aug. 2, 1974

[21] Appl. No.: 494,165

[52] U.S. Cl. ..... 165/92; 134/124

[51] Int. Cl.[2] ..... F28F 5/04

[58] Field of Search ..... 34/124, 125, 108, 109; 165/86–92

[56] References Cited

UNITED STATES PATENTS

| | | | |
|---|---|---|---|
| 755,193 | 3/1904 | Valerius | 165/89 |
| 1,656,790 | 1/1928 | Heijkenskjold | 165/86 |
| 1,689,189 | 10/1928 | Broadhurst | 165/92 |
| 2,205,431 | 6/1940 | Olson, Jr. | 165/92 |
| 2,610,033 | 9/1952 | Rietz | 165/87 |
| 3,800,865 | 5/1971 | Onarheim et al. | 165/92 |

FOREIGN PATENTS OR APPLICATIONS

| | | | |
|---|---|---|---|
| 86,456 | 6/1894 | Germany | 165/86 |
| 936,059 | 9/1963 | United Kingdom | 165/90 |

*Primary Examiner*—Charles J. Myhre
*Assistant Examiner*—Theophil W. Streule, Jr.
*Attorney, Agent, or Firm*—Burd, Braddock & Bartz

[57] ABSTRACT

Heat exchanging apparatus for handling solids, slurries, gels, filter cakes, powders, and the like, for continuous indirect heating, drying, cooling or reaction of materials passed through the apparatus. The dryer/-heater/cooler apparatus is characterized by a stationary horizontal vessel with a rotary heat exchanger including a tubular shaft on which are mounted a plurality of hollow vertical discs through which a heat exchanging fluid is passed. Material to be treated is admitted to one end of the apparatus housing, transported in an axial direction through the annular space between the rotor discs and the vessel toward the discharge end and discharged through an overflow weir after the desired residence time. Several rotor disc designs are shown and described.

6 Claims, 7 Drawing Figures

ROTARY DISC TYPE HEAT EXCHANGER

This invention relates to apparatus for drying, heating or cooling of materials by continuous indirect heat exchange in the course of passage of the material through a stationary horizontal vessel housing in contact with a horizontal axis rotor having a plurality of hollow vertical discs mounted in series on a tubular shaft.

In U.S. Pat. No. 3,777,810, issued Dec. 11, 1973 to David L. Phillips, one of the present applicants, there is disclosed apparatus for drying moist solid material of the type utilizing disc heat exchange elements into which a heating fluid is introduced and from which cooled fluid is withdrawn, the material being dried through contact with a plurality of discs in its passage through the apparatus. The apparatus of that patent is characterized by torus discs formed from relatively thin-walled circular metal plates and having a plurality of concentric rings of convex arcuate cross section, each enclosing a plurality of interconnected concentric generally toroidal chambers through which heating fluid is circulated in parallel successively from the innermost to the outermost. The present invention is directed to apparatus of the same general type utilizing in series heat exchanging disc type rotors of modified design. The disclosure of the aforesaid prior patent is incorporated herein by reference.

The invention is illustrated by the accompanying drawings in which.

Figure 1:
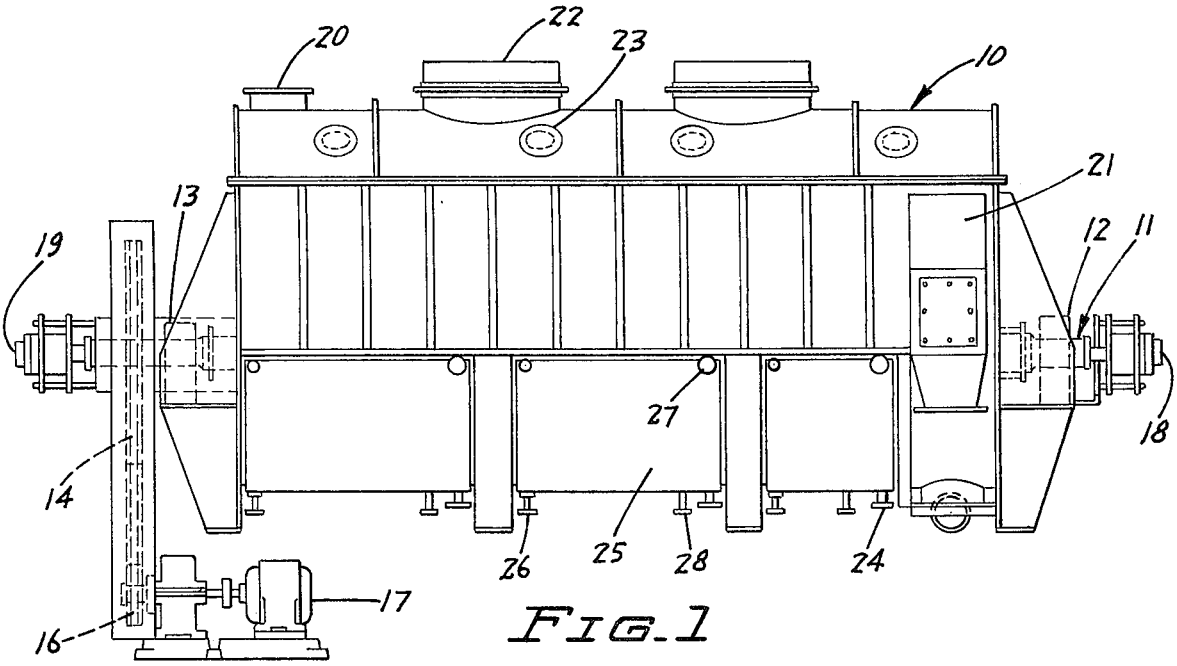
FIG. 1 is a side elevation of one form of apparatus according to the present invention.
Figure 2:
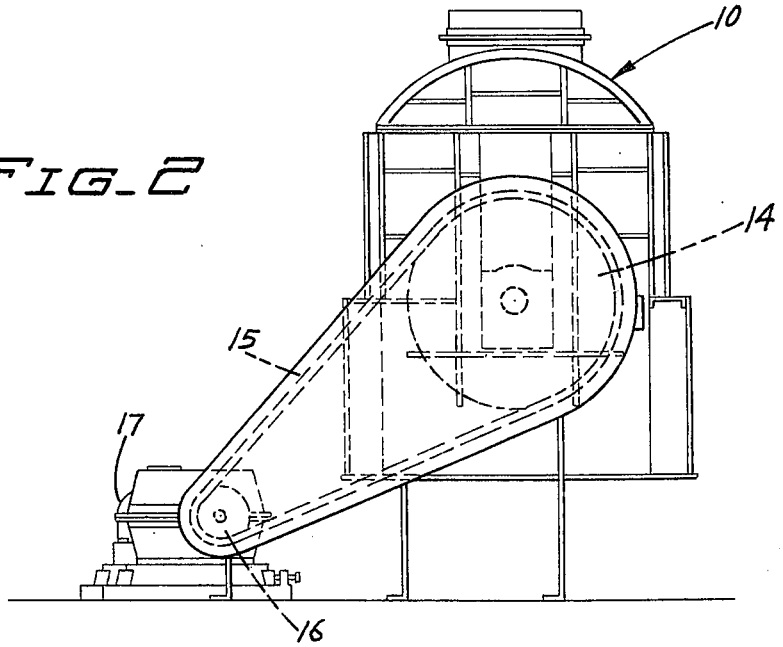
FIG. 2 is a left end elevation of said apparatus.

Referring to the drawings, the form of apparatus shown in FIGS. 1 and 2 comprises a horizontally disposed stationary housing 10, which may be of circular or oval or U-shaped cross section and suitably supported. A hollow tubular shaft, indicated generally at 11, extends lengthwise through the end walls of the housing, being provided with suitable seals and journaled for rotation on a horizontal axis in bearings 12 and 13 mounted outside of the opposite end walls of the housing. A drive sprocket 14 is secured to one end of the shaft connected by chain 15 to a driven sprocket 16 driven from a suitable power source, such as motor 17. One end of the shaft 18 is an inlet for a heat exchange fluid and the opposite end of the shaft 19 is an outlet for that fluid.

A material inlet 20 to the housing is provided adjacent one end. A discharge weir 21 communicates with the interior of the housing through the wall adjacent the opposite end from the inlet for removal of treated material. One or more vents 22, sight ports 23, drains 24, and the like, may be provided as desired or needed. The housing 10 is desirably double walled over at least part of its surface being provided with one or more jackets 25, each having an inlet 26 and outlet 27 for introduction and discharge of a heating fluid to the narrow space between the housing wall and jacket wall. Each jacket is also desirably provided with a drain 28. The illustrated apparatus is merely exemplary of one form of housing in which the disc type heat exchangers, according to the present invention, may be utilized.

Figure 3:
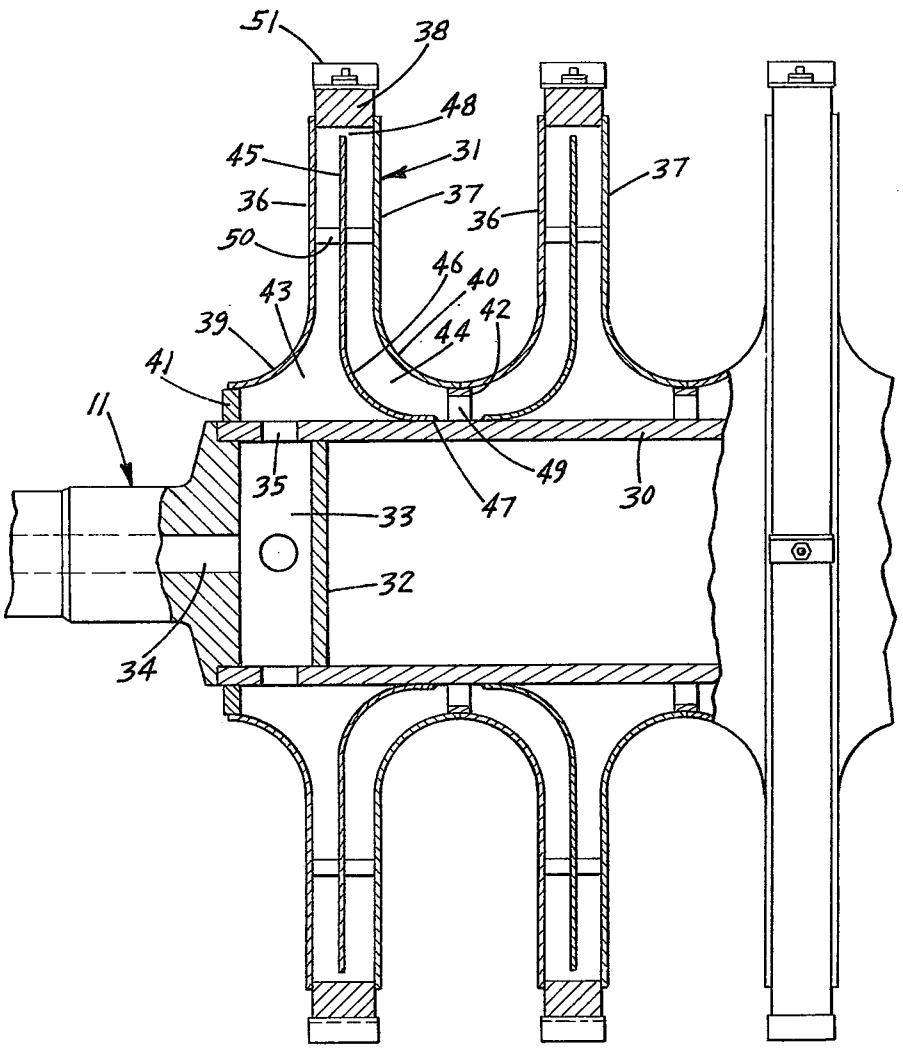
FIG. 3 is a fragmentary side elevation, partly in section and partly broken away, showing details of structure of one form of heat exchange rotor.

Referring now to FIG. 3, the portion of shaft 11 within the housing includes a tubular body 30 of increased diameter on which are mounted a plurality of hollow discs, indicated generally at 31. Discs 31 are vertically disposed, generally perpendicular to the axis of the rotor. A circular plate 32 which is perpendicular to the rotor axis is secured in sealed relation adjacent one end of tube 30 so as to define a chamber 33 which is in communication with passage 34 in the end of the shaft and through radial holes 35 in the wall of tube 30 with the interior of the endmost disc 31.

Each disc 31 includes a pair of spaced apart annular walls 36 and 37 in the form of plates secured at their outer peripheries in sealed fluid-tight relation, as by welding, to the opposite sides of a ring 38 which forms the outer periphery of the hollow disc. Disc walls 36 and 37 are formed from heat conductive metal sheet, such as stainless steel or the like. The inner peripheries 39 and 40 of annular disc walls 36 and 37, respectively, are dished outwardly through about a 90° turn to form a hub-like structure. The free inner peripheral edge of the endmost disc wall 36 is secured in sealed relation, as by welding, to an annular end ring 41 which in turn is secured in sealed relation to shaft tube 30, as by welding. The inner peripheral edge of dished portion 40 of annular disc wall 37 and the corresponding portion of the wall 36 of the next adjacent disc are both secured in sealed relation, as by welding, to a ring 42 surrounding and spaced outwardly from shaft tube 30.

The interior of each hollow disc 31 is divided into a pair of relatively thin flat side-by-side annular chambers or passages 43 and 44 by means of an annular partition wall 45 disposed approximately midway between disc walls 36 and 37. The inner periphery 46 of partition wall 45 is likewise dished and the innermost edge 47 is secured in sealed relation as by welding to the outer periphery of shaft tube 30. The outside diameter of partition wall 45 is just slightly less than the inside periphery of ring 38 such that a narrow annular passage 48 connects disc chambers 43 and 44. Thus a heating or cooling fluid introduced through passage 34 in the shaft enters chamber 35, is dispersed outwardly through radial holes 35 in the shaft tube wall into chamber 43, and thence outwardly toward passage 48, through that passage into chamber 44 and through the annular passage 49 between ring 42 and shaft tube 30 to the next adjacent disc. The flow through each successive disc is the same and the discharge at the opposite end of the shaft is merely the reverse of the entrance.

A plurality of uniformly spaced apart stay-bolts or pins 50 maintain partition 45 midway between the disc side walls and insure against collapse of the discs from either internal or outside excess pressure. Stay-bolts 50 permit the use of thinner sheet material for better heat exchange than otherwise would be possible and insure a rigid stable rotor structure. Optionally a plurality of internal vanes radiating from shaft tube 30 may be disposed within the disc chambers in order to direct flow of the heating or cooling fluid in fixed channels.

Transport of product to be treated is in an axial direction through the housing in the annular space between the outer peripheries of the discs and the inner vessel wall toward the discharge end by means of a plurality of adjustable conveying vanes 51 affixed to the outer rims of the discs 31. The conveying vanes 51 may be adjusted for mixing of the product so that back mixing of wet and dry product may be accomplished in one step when necessary for products that in the wet stage are not free flowing. As pointed out in the aforesaid prior patent, material buildup at high heat transfer areas may be prevented and a high relative velocity may be maintained between the rotating discs and the product by means of stationary agitator plows or scraper bars located between adjacent discs.

Figure 4:
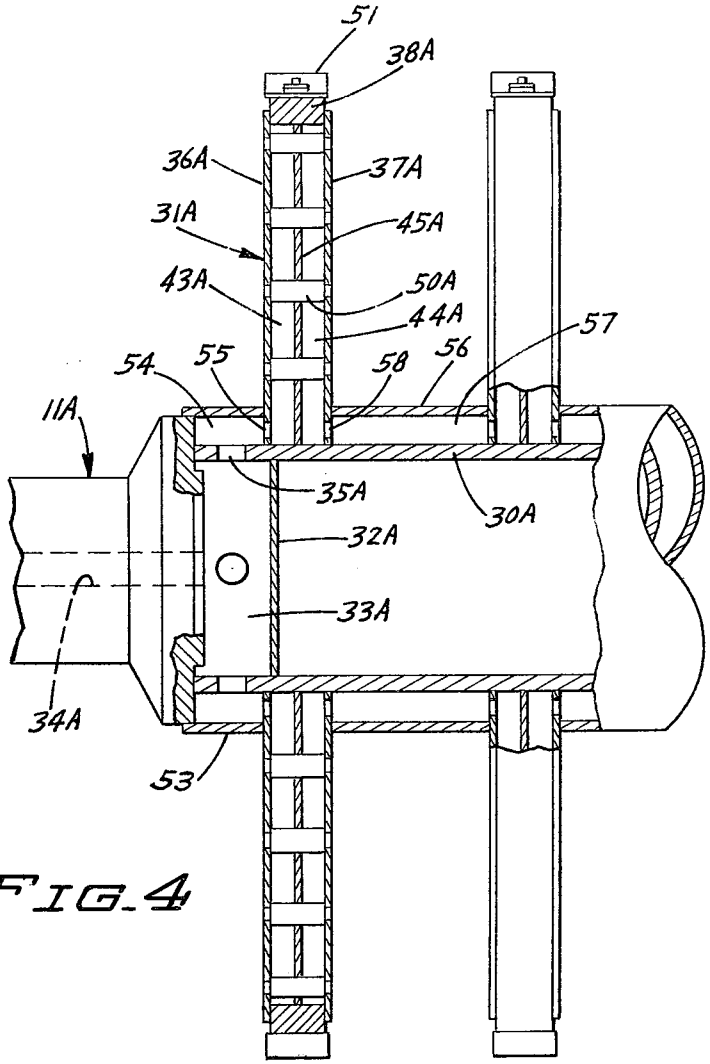
FIG. 4 is a similar fragmentary elevation of another form of rotor.
Figure 5:
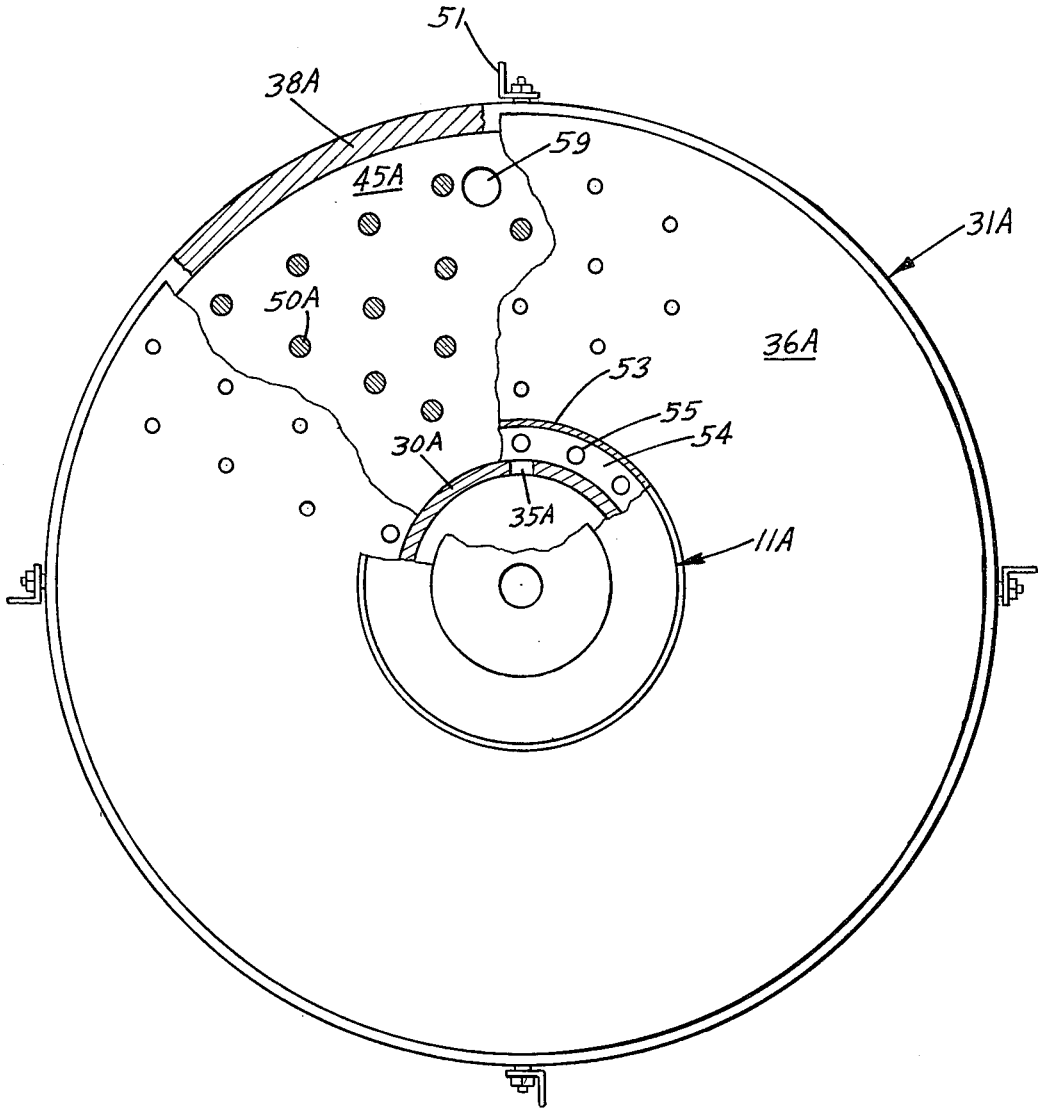
FIG. 5 is an end elevation, partly broken away and in section, of the rotor of FIG. 4.

An alternative form of rotor and disc structure is shown in FIGS. 4 and 5. To the extent feasible, the same numerals are used to identify corresponding parts with the suffix A added. According to this alternative form of disc construction, discs 31A include side walls 36A and 37A, both in the form of flat circular rings secured at their inner peripheries to the outer periphery of shaft tube 30A and at their outer peripheries to ring 38A. An outer ring 53 which is concentric with and of larger diameter than shaft tube 30 is secured at one end to the hub of shaft 11A and at the other end to the wall 36A of endmost disc 31A. The area between ring 53 and tube 30A defines an annular chamber 54 which is in direct fluid communication with radial passages 35A through the shaft tube. A plurality of passages 55 are formed in disc wall 36A adjacent the inner perimeter to permit disc chamber 43A to communicate with rotor chamber 54 for passage of heating or cooling fluid.

A ring 56, corresponding to ring 53, is disposed between each adjacent pair of discs 31 to define a plurality of annular chambers 57 for passage of treating fluid between adjacent discs. Disc wall 37A is provided with a plurality of passages 58 spaced about its inner periphery to provide communication between disc chamber 44A and rotor chamber 57. Partition 45A separates chambers 43A and 44A except for a plurality of spaced apart holes 59 adjacent the outer periphery of the partition which function as passages between the disc chambers. Stay-bolts or pins 50A maintain the spacings between the disc walls and partition.

The flow pattern for heat exchange fluid is generally as earlier described, through passage 34A into chamber 33A, through passages 35A into annular chamber 54, through passages 55 into disc chamber 43A and outwardly to passages 59, inwardly through disc chamber 44A, through passages 58 to annular chamber 57 and thence to the next adjacent disc.

Figures 6, 7:
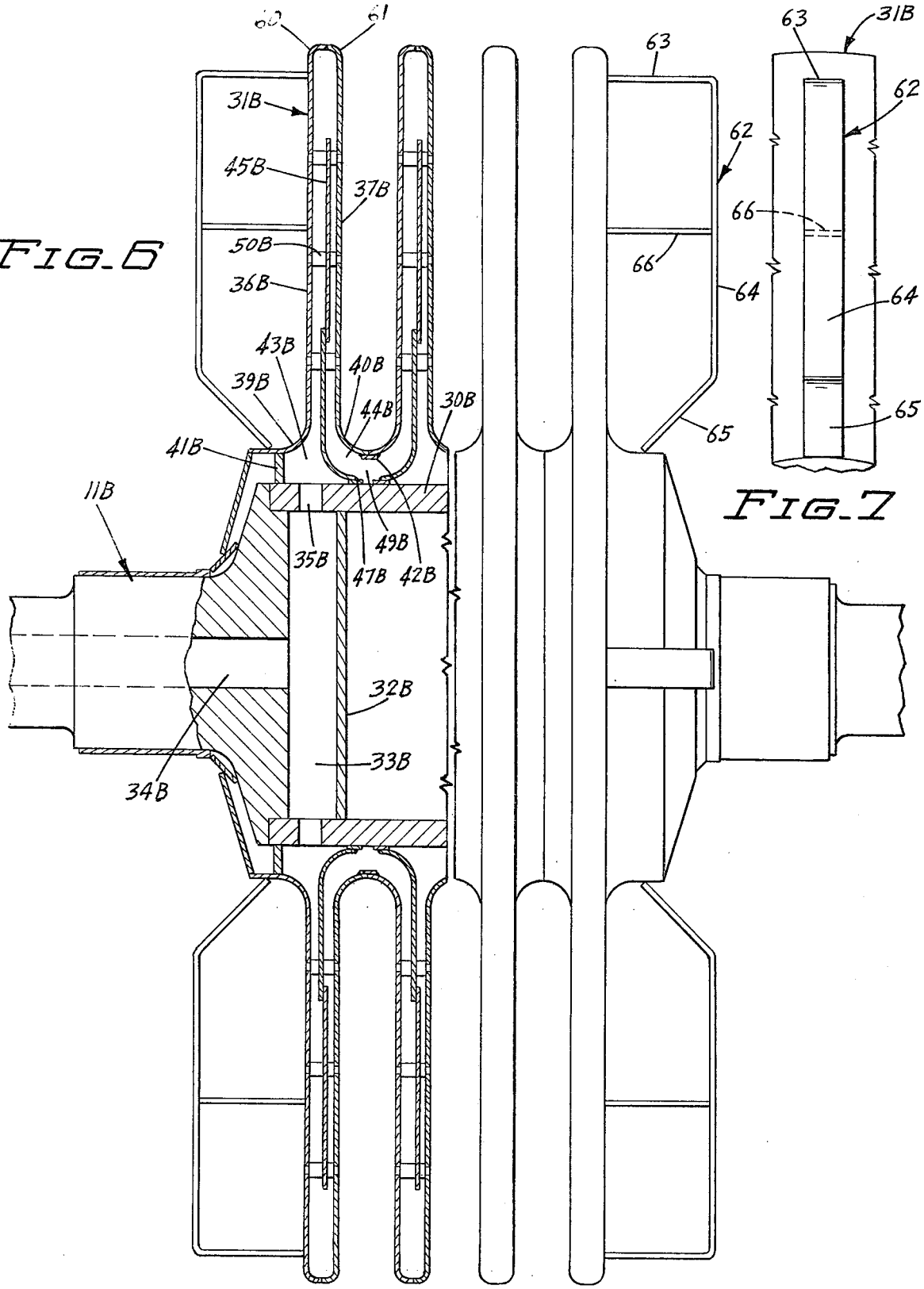
FIG. 6 is a fragmentary side elevation showing still another form of rotor structure.
FIG. 7 is a fragmentary end elevation showing a form of material agitator means mounted on an endmost disc.

FIGS. 6 and 7 show another alternative form of rotor disc construction. Again, so far as feasible the same numerals are utilized to identify corresponding parts with the suffix B added. According to this modified form of construction, each hollow disc 31B is comprised of a pair of annular side walls 36B and 37B dished outwardly adjacent their inner peripheries at 39B and 40B, respectively, as described in connection with FIG. 3, and also dished inwardly at 60 and 61, respectively, where the outer peripheral edges are secured together in sealed relation as by welding. Disc chambers 43B and 44B are separated by a partition 45B and the chambers are in communication through passage 48B adjacent the outer perimeter of the partition. The flow of heating or cooling fluid through this form of rotor is generally as previously described.

Agitator means 62 may optionally be provided secured on the endmost disc as shown. Each agitator means is a strap-like member having a horizontal component 63 extending axially of the rotor, a vertical component 64 extending radially and a diagonal component 65 extending inwardly from the end of the rotor adjacent the inner periphery of the disc. An intermediate horizontal bracing member 66 is desirably also provided.

The rotors according to any of the forms of construction may be divided into sections to allow gradual heating and cooling processes using different heat transfer media with different temperatures. Water, heat transfer oils, steam, halogenated hydrocarbons, such as Freon, and the like, are typical heat transfer fluids which may be utilized with the heat exchanger rotors according to the present invention. Where steam is used, then provision is made for discharge of condensate as described in the aforesaid prior patent.

In contrast to heat exchangers of the positive displacement hollow screw type, apparatus utilizing the rotors according to the present invention may be operated at the speed that gives optimum heat transfer since residence time is independent of rotor speed and is adjustable with the overflow weir located at the discharge end.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. Heat exchange apparatus for the treatment of materials, said apparatus comprising:

A. a horizontally disposed housing having a material inlet adjacent one end and a material discharge adjacent the other end, B. a rotor shaft extending longitudinally through said housing journaled for rotation on a horizontal axis and carrying a plurality of axially spaced apart hollow disc multiple chamber heat exchange elements for rotation therewith within the housing, said rotor shaft including:

1. an axial passage adjacent each end, and

2. a plurality of radial passages extending from said axial passages adjacent to the endmost disc heat exchange elements on said shaft in communication with the endmost chambers of said heat exchange elements, C. a pair of facing generally parallel closely spaced apart annular plate side walls comprising each heat exchange element and extending generally perpendicular to the rotor axis,

1. the inner peripheral edges of the facing disc side walls of adjacent disc heat exchange elements being dished outwardly through about a 90° turn and into abutment with each other, and

2. said peripheral edges being secured in sealed relation to a mounting ring surrounding said rotor and spaced outwardly therefrom, D. an annular partition disposed between each pair of said side walls and generally parallel thereto, said partition being secured to said shaft and dividing said heat exchange element into chambers, 1. the inner peripheral edge of the partition within each disc heat exchange element being dished through about a 90° turn concentrically with one of said disc side walls to define an arcuate annular unobstructed passage with that disc side wall, and 2. said peripheral edge being secured in sealed relation to said rotor, E. substantially unobstructed annular passage means within each of said heat exchange elements adjacent the outer peripheral edge of each partition, said passage connecting adjacent chambers on opposite sides of said partitions, F. substantially unobstructed annular passage means adjacent the inner peripheries of the endmost chambers of said heat exchange elements for introduction of heat exchange fluid to and withdrawal from said chambers and further substantially unobstructed axially spaced annular passage means through said mounting rings adjacent the inner peripheries of each adjacent pair of heat exchange elements on the opposite sides of said partitions, and G. a plurality of uniformly spaced apart stay-bolt means spaced radially outwardly from the shaft and extending between said side walls and partition of each disc to maintain the walls in fixed rigid spaced apart relation.

2. An apparatus according to claim 1 further characterized in that:

A. said housing is double-walled over at least part of its surface, and

B. inlet and outlet means are provided in communication with the space between said walls for circulation of heating fluid therein.

3. An apparatus according to claim 1 further characterized in that said inner peripheral edge of the partition is first secured in sealed relation to a ring surrounding said rotor which is in turn secured in sealed relation with the rotor.

4. A hollow disc heat exchange rotor comprising:

A. an elongated horizontal axis shaft,

B. a plurality of axially spaced apart hollow disc heat exchange elements carried on said shaft, C. a pair of facing generally parallel closely spaced apart annular plate side walls comprising each heat exchange element and extending generally perpendicular to the rotor axis, 1. the inner peripheral edges of the facing disc side walls of adjacent disc heat exchange elements being dished outwardly through about a 90° turn and into abutment with each other, and 2. said peripheral edges being secured in sealed relation to a mounting ring surrounding said rotor and spaced outwardly therefrom, D. an annular partition disposed between each pair of said side walls and generally parallel thereto, said partition being secured to said shaft and dividing said heat exchange element into chambers, 1. the inner peripheral edge of the partition within each disc heat exchange element being dished through about 90° turn concentrically with one of said disc side walls to define an arcuate annular unobstructed passage with that disc side wall, and 2. said peripheral edge being secured in sealed relation to said rotor, E. substantially unobstructed annular passage means within each of said heat exchange elements adjacent the outer peripheral edge of each partition, said passage connecting adjacent chambers on opposite sides of said partitions, F. substantially unobstructed annular passage means adjacent the inner peripheries of each of the endmost chambers of said heat exchange elements for introduction of heat exchange fluid to and discharge from said chambers and further substantially unobstructed axially spaced annular passage means through said mounting rings adjacent the inner peripheries of each adjacent pair of heat exchange elements on the opposite sides of said partitions, and G. a plurality of uniformly spaced apart stay-bolt means spaced radially outwardly from the shaft and extending between said side walls and partitions of each disc to maintain the same in fixed rigid spaced apart relation.

5. A heat exchange rotor according to claim 4 further characterized in that said inner peripheral edge of the partition is first secured in sealed relation to a ring surrounding said rotor which in turn is secured in sealed relation with the rotor.

6. A disc heat exchange element for mounting in axially spaced apart relation on a rotor shaft, said disc comprising:

A. a pair of facing generally parallel spaced apart annular plate side walls, 1. the inner peripheral edges of the disc side walls being dished outwardly through about a 90° turn, and 2. at least one of said peripheral edges being secured in sealed relation to a mounting ring adapted to surround said rotor shaft spaced outwardly therefrom, B. an annular partition disposed between said side walls and generally parallel thereto, said partition dividing said disc into chambers, and the inner peripheral edge of the partition within the disc being dished through about a 90° turn concentrically with the first of the disc side walls to define an annular unobstructed passage with the first disc side wall adjacent the inner periphery thereof in communication with the first of said chambers, C. substantially unobstructed annular passage means within said disc adjacent the outer periphery of the partition and connecting adjacent chambers on opposite sides of said partition, D. further substantially unobstructed annular passage means adjacent the inner periphery of the other of said side walls on the opposite side of said partition in communication with the other of said chambers, and E. a plurality of uniformly spaced apart stay-bolt means spaced radially outwardly from the inner periphery of the side walls and extending between said side walls and partition to maintain the same in fixed rigid spaced apart relation.

* * * * *